US012258958B2

(12) United States Patent
Wang et al.

(10) Patent No.: US 12,258,958 B2
(45) Date of Patent: Mar. 25, 2025

(54) MOUNTING BRACKET AND AUXILIARY MECHANISM

(71) Applicant: YANTAI JEREH PETROLEUM EQUIPMENT & TECHNOLOGIES CO., LTD., Shandong (CN)

(72) Inventors: Jianwei Wang, Shandong (CN); Xiaolei Ji, Shandong (CN); Rikui Zhang, Shandong (CN); Peng Zhang, Shandong (CN); Zhuqing Mao, Shandong (CN); Chunqiang Lan, Shandong (CN); Yipeng Wu, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 15 days.

(21) Appl. No.: 17/736,566

(22) Filed: May 4, 2022

(65) Prior Publication Data

US 2023/0064964 A1 Mar. 2, 2023

(51) Int. Cl.
*F04B 53/22* (2006.01)

(52) U.S. Cl.
CPC ..... *F04B 53/22* (2013.01)

(58) Field of Classification Search
CPC ..... F04B 53/22
See application file for complete search history.

(56) References Cited

U.S. PATENT DOCUMENTS

| | | | | |
|---|---|---|---|---|
| 3,983,429 | A * | 9/1976 | Allardice, Jr. | H02K 5/24 310/91 |
| 7,191,998 | B1 * | 3/2007 | Chalberg | F04D 29/605 248/676 |
| 10,815,764 | B1 | 10/2020 | Yeung et al. | |
| 2017/0152843 | A1 | 6/2017 | Bei et al. | |
| 2022/0316362 | A1 * | 10/2022 | Zhang | F01N 13/00 |
| 2023/0212933 | A1 * | 7/2023 | Zhang | F01D 25/30 60/39.5 |

FOREIGN PATENT DOCUMENTS

| | | |
|---|---|---|
| CN | 204827837 U | 12/2015 |
| CN | 205925547 U | 2/2017 |
| CN | 206490531 U | 9/2017 |
| CN | 208811362 U | 5/2019 |
| CN | 211523458 U | 9/2020 |

* cited by examiner

*Primary Examiner* — Anita M King
(74) *Attorney, Agent, or Firm* — Crowell & Moring LLP

(57) ABSTRACT

A mounting bracket and an auxiliary mechanism are disclosed. The mounting bracket includes a mounting base, a first mounting plate, a second mounting plate and a tubular connection structure; the first mounting plate and the second mounting plate are fixed on the mounting base; the second mounting plate and the first mounting plate are oppositely arranged and spaced apart; the first mounting plate includes at least one first mounting hole and a first fixing hole, the second mounting plate includes a second fixing hole, and the first mounting hole is configured to mount a motor or an oil pump; one end of the tubular connection structure is connected with an edge of the first fixing hole, and another end of the tubular connection structure is connected with an edge of the second fixing hole.

16 Claims, 5 Drawing Sheets

MOUNTING BRACKET AND AUXILIARY MECHANISM

The present application is based on and claims priority to Chinese Patent Application No. 202122065434.8 filed with CNIPA on Aug. 30, 2021, the present disclosure of which is incorporated herein by reference in their entirety as part of the present disclosure.

TECHNICAL FIELD

Embodiments of the present disclosure relate to a mounting bracket and an auxiliary mechanism.

BACKGROUND

In a field of oil and gas exploitation, fracturing technology refers to a technology that uses high-pressure fracturing fluid to form cracks in oil and gas reservoirs during oil or gas production. Through fracturing technology, cracks are formed in oil and gas reservoirs, which can improve the underground flowing environment of oil or natural gas and increase the output of oil wells.

Generally, a fracturing device includes a prime mover, a reduction gearbox, a plunger pump and an auxiliary mechanism. One end of the reduction gearbox is connected with the prime mover, and another end of the reduction gearbox is connected with the plunger pump; the prime mover provides mechanical power to the plunger pump through the reduction gearbox, and the plunger pump uses a crankshaft connecting rod mechanism to convert a rotation of a crankshaft into a reciprocating motion of the plunger, and uses the reciprocating motion of the plunger in a cavity inside a valve box to pressurize a liquid, thus forming high-pressure fracturing fluid.

In a working process of the fracturing device, the prime mover needs an auxiliary mechanism to provide fuel, and the reduction gearbox and plunger pump both need the auxiliary mechanism to lubricate, so the auxiliary mechanism is also an important component of the fracturing device. Generally, the auxiliary mechanism may include a fuel supply mechanism and a lubricating mechanism, and the fuel supply mechanism may include a fuel oil pump and a motor driving the fuel oil pump; the lubricating mechanism may include a lubricating oil path, a lubricating oil pump driving the lubricating oil path and a motor driving the lubricating oil pump.

SUMMARY

Embodiments of the present disclosure provide a mounting bracket and an auxiliary mechanism. The mounting bracket includes a mounting base, a first mounting plate, a second mounting plate and a tubular connection structure; the first mounting plate and the second mounting plate are fixed on the mounting base; the second mounting plate and the first mounting plate are oppositely arranged and spaced apart; the first mounting plate includes at least one first mounting hole and a first fixing hole, the second mounting plate includes a second fixing hole, and the first mounting hole is configured to mount a motor or an oil pump; the tubular connection structure is located between the first mounting plate and the second mounting plate, one end of the tubular connection structure is connected with an edge of the first fixing hole, and another end of the tubular connection structure is connected with an edge of the second fixing hole. Therefore, the mounting bracket can be used for mounting a motor or an oil pump, and the mounting bracket is lightweight designed on the premise of high stability, so that the integration and the compactness of an auxiliary mechanism adopting the mounting bracket are improved, and the weight of the auxiliary mechanism is reduced.

At least one embodiment of the present disclosure provides a mounting bracket, which includes: a mounting base; a first mounting plate fixed on the mounting base; and a second mounting plate fixed on the mounting base and arranged opposite to and spaced apart from the first mounting plate, the first mounting plate includes at least one first mounting hole and a first fixing hole, the second mounting plate includes a second fixing hole, and the first mounting hole is configured to mount a motor or an oil pump, the mounting bracket further includes a tubular connection structure between the first mounting plate and the second mounting plate, one end of the tubular connection structure is connected with an edge of the first fixing hole, and another end of the tubular connection structure is connected with an edge of the second fixing hole.

For example, in the mounting bracket provided by an embodiment of the present disclosure, the second mounting plate includes at least one second mounting hole configured to mount a motor or an oil pump.

For example, in the mounting bracket provided by an embodiment of the present disclosure, an orthographic projection of one of the at least one second mounting hole on the first mounting plate is at least partially overlapped with one of the at least one first mounting hole.

For example, in the mounting bracket provided by an embodiment of the present disclosure, the first mounting plate includes a plurality of first mounting holes, and the plurality of first mounting holes are arranged around the first fixing hole.

For example, in the mounting bracket provided by an embodiment of the present disclosure, a number of the plurality of first mounting holes can be any one of 2, 3 and 4.

For example, in the mounting bracket provided by an embodiment of the present disclosure, the mounting base includes: a mounting portion; and a fixing portion, one end of the fixing portion being connected with the mounting portion, and another end of the fixing portion being configured to be connected with an external device, the mounting portion includes a lightening hole, one end of the first mounting plate is fixed in a first region of the mounting portion, one end of the second mounting plate is fixed in a second region of the mounting portion, and the first region and the second region are located at both sides of the lightening hole.

For example, in the mounting bracket provided by an embodiment of the present disclosure, the fixing portion includes: a fixing plate; a connecting plate, one end of the connecting plate being connected with the fixing plate and another end of the connecting plate being connected with the mounting portion; and a rib plate located in an included angle between the fixing plate and the connecting plate and connected with the fixing plate and the connecting plate, respectively.

For example, the mounting bracket provided by an embodiment of the present disclosure further includes: an enclosing plate located between the first mounting plate and the second mounting plate and connected with edges of the first mounting plate and the second mounting plate, the enclosing plate and the mounting base enclose a space between the first mounting plate and the second mounting plate, and the enclosing plate includes at least one of a maintenance window and an observation window.

For example, the mounting bracket provided by an embodiment of the present disclosure further includes: a first bracket connected with the first mounting plate and including a first connection portion; a second bracket connected with the second mounting plate and including a second connection portion, the first connection portion and the second connection portion are oppositely arranged and spaced apart, and the first connection portion and the second connection portion are respectively configured to connect a motor and an oil pump.

For example, in the mounting bracket provided by an embodiment of the present disclosure, a distance between the first connection portion and the second connection portion is greater than a distance between the first mounting plate and the second mounting plate.

At least one embodiment of the present disclosure further provides an auxiliary mechanism, which includes: any one of the abovementioned mounting bracket; at least one motor; and at least one oil pump, the first mounting hole is provided with one of the at least one motor or one of the at least one oil pump.

For example, in the auxiliary mechanism provided by an embodiment of the present disclosure, the at least one motor includes a first motor, and the at least one oil pump includes a first oil pump, the first oil pump is mounted in the first mounting hole, and the first motor is connected with an end of the first oil pump away from the first mounting plate and is configured to directly drive the first oil pump.

For example, in the auxiliary mechanism provided by an embodiment of the present disclosure, the mounting bracket further includes a first bracket connected with the first mounting plate and including a first connection portion; a second bracket connected with the second mounting plate and including a second connection portion, the first connection portion and the second connection portion are oppositely arranged and spaced apart, the at least one motor includes a second motor, and the at least one oil pump includes a second oil pump and a third oil pump, one end of the second oil pump is connected with the first connection portion, and one end of the third oil pump is connected with the second connection portion, the second motor is connected to the end of the second oil pump connected with the first connection portion and configured to directly drive the second oil pump, the second oil pump includes a power output shaft, and the power output shaft of the second oil pump is connected with one end of the third oil pump away from the second connection portion and configured to directly drive the third oil pump.

For example, in the auxiliary mechanism provided by an embodiment of the present disclosure, a type of the at least one motor includes at least one of a hydraulic motor and an electric motor.

For example, in the auxiliary mechanism provided by an embodiment of the present disclosure, a type of the at least one oil pump includes at least one of a lubricating oil pump and a fuel oil pump.

BRIEF DESCRIPTION OF THE DRAWINGS

In order to clearly illustrate the technical solution of the embodiments of the present disclosure, the drawings of the embodiments will be briefly described. It is apparent that the described drawings are only related to some embodiments of the present disclosure and thus are not limitative of the present disclosure.

DETAILED DESCRIPTION

Figure 1:
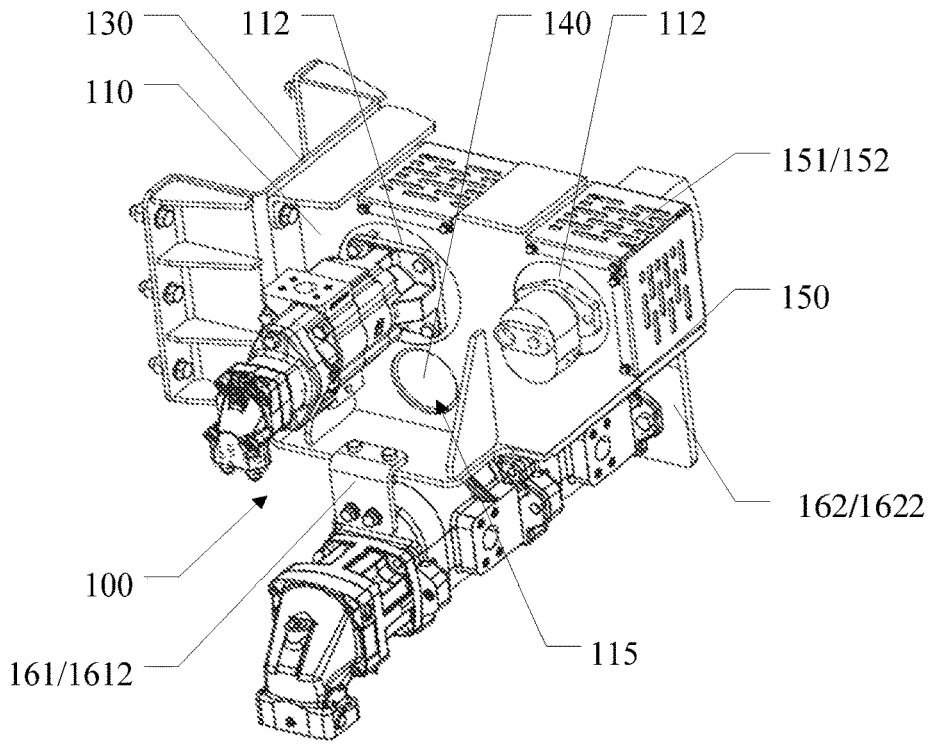
FIG. 1 is a structural schematic diagram of a first side of a mounting bracket provided by an embodiment of the disclosure.

In order to make objects, technical details and advantages of embodiments of the present disclosure clear, the technical solutions of the embodiments will be described in a clearly and fully understandable way in connection with the related drawings. It is apparent that the described embodiments are just a part but not all of the embodiments of the present disclosure. Based on the described embodiments herein, those skilled in the art can obtain, without any inventive work, other embodiment(s) which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and claims of the present disclosure, are not intended to indicate any sequence, amount or importance, but distinguish various components. The terms "comprises," "comprising," "includes," "including," etc., are intended to specify that the elements or the objects stated before these terms encompass the elements or the objects listed after these terms as well as equivalents thereof, but do not exclude other elements or objects. The phrases "connect", "connected", etc., are not intended to define a physical connection or a mechanical connection, but may comprise an electrical connection which is direct or indirect.

With a continuous development of fracturing device, fracturing device (especially mobile fracturing device) puts forward higher requirements for the integration, compactness and light weight of the whole device.

In an auxiliary mechanism of a fracturing device, an oil pump (such as lubricating oil pump or fuel oil pump) and a motor need to be connected by coupling, while the motor, coupling and oil pump need a high coaxiality. If the coaxiality is not high, it will easily reduce the mechanical efficiency of the oil pump, generate noise, and lead to damage and failure of the oil pump, motor and coupling, and shorten the service life. Moreover, if a weight of the auxiliary system is large, it is easy to produce large vibration, which will lead to various defects such as coupling damage.

Therefore, the embodiments of the present disclosure provide a mounting bracket and an auxiliary mechanism. The mounting bracket includes a mounting base, a first mounting plate, a second mounting plate and a tubular connection structure; the first mounting plate and the second mounting plate are fixed on the mounting base; the second mounting plate and the first mounting plate are oppositely arranged and spaced apart; the first mounting plate includes at least one first mounting hole and a first fixing hole, the second mounting plate includes a second fixing hole, and the first mounting hole is configured to mount a motor or an oil pump; the tubular connection structure is located between the first mounting plate and the second mounting plate, one end of the tubular connection structure is connected with an edge of the first fixing hole, and another end of the tubular connection structure is connected with an edge of the second fixing hole. Therefore, the mounting bracket can be used for mounting a motor or an oil pump, and the mounting bracket is lightweight designed on the premise of high stability, so that the integration and the compactness of the auxiliary mechanism adopting the mounting bracket are improved, and the weight of the auxiliary mechanism is reduced.

Hereinafter, the mounting bracket and auxiliary mechanism provided by embodiments of the present disclosure will be described in detail with reference to the accompanying drawings.

Figure 2:
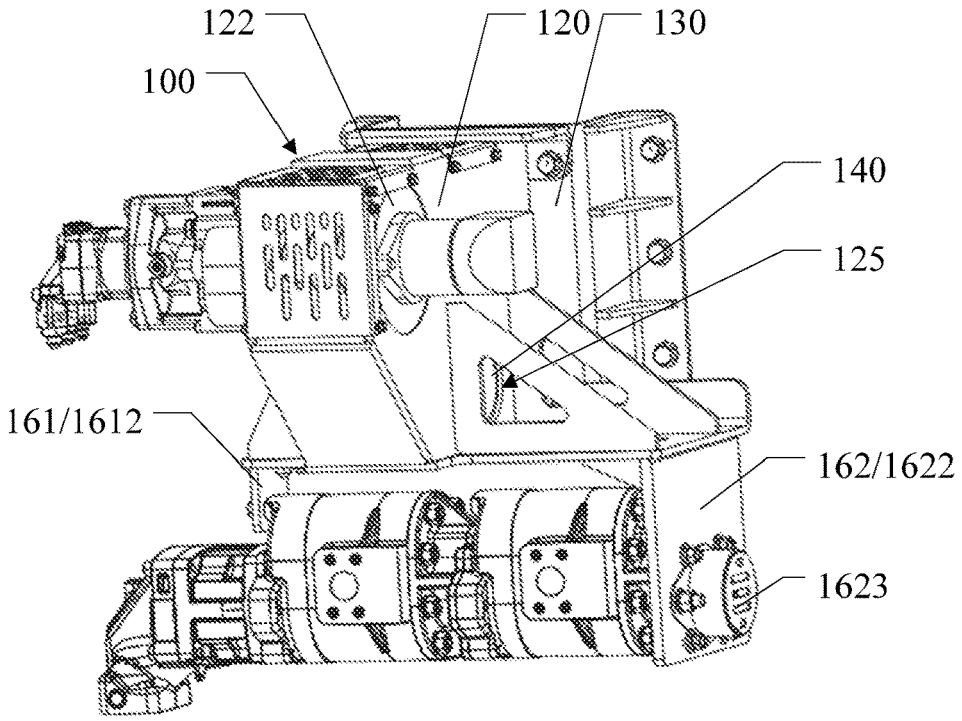
FIG. 2 is a structural schematic diagram of a second side of a mounting bracket provided by an embodiment of the disclosure.

At least one embodiment of the present disclosure provides a mounting bracket. FIG. 1 is a structural schematic diagram of a first side of a mounting bracket provided by an embodiment of the disclosure; FIG. 2 is a structural schematic diagram of a second side of a mounting bracket provided by an embodiment of the disclosure. As illustrated by FIG. 1 and FIG. 2, a mounting bracket 100 includes a mounting base 130, a first mounting plate 110 and a second mounting plate 120. The first mounting plate 110 and the second mounting plate 120 are respectively fixed on the mounting base 130; the second mounting plate 120 and the first mounting plate 110 are oppositely arranged and spaced apart; the first mounting plate 110 includes at least one first mounting hole 112 and a first fixing hole 115, and the second mounting plate 120 includes a second fixing hole 125. The first mounting hole 112 is configured to mount a motor or an oil pump.

For example, the motor can be an electric motor or a hydraulic motor; the oil pump can be a lubricating oil pump or a fuel oil pump.

As illustrated by FIG. 1 and FIG. 2, the mounting bracket 100 further includes a tubular connection structure 140; the tubular connection structure 140 is located between the first mounting plate 110 and the second mounting plate 120. One end of the tubular connection structure 140 is connected with an edge of the first fixing hole 115, and another end of the tubular connection structure 140 is connected with an edge of the second fixing hole 125. It should be noted that the above-mentioned tubular connection structure is a hollow tubular structure, and both ends of the tubular connection structure respectively include a first circular edge and a second circular edge, the first circular edge is connected with the edge of the first fixing hole (for example, the connection can be realized by welding), and the second circular edge is connected with the edge of the second fixing hole.

In the mounting bracket provided by the embodiment of the present disclosure, because the first mounting plate 110 and the second mounting plate 120 are respectively fixed on the mounting base 130, the first mounting plate 110 and the second mounting plate 120 are oppositely arranged and spaced apart, and the mounting bracket 100 further fixes the first mounting plate 110 and the second mounting plate 120 through the tubular connection structure 140, the first fixing hole 115 and the second fixing hole 125; meanwhile, the first fixing hole 115 and the second fixing hole 125 can also be used as lightening holes to reduce the weight of the first mounting plate 110 and the second mounting plate 120, respectively. Therefore, the mounting bracket can realize a stable and lightweight mounting bracket. The mounting bracket can be used for mounting a motor or an oil pump, and the mounting bracket is lightweight designed on the premise of high stability, so that the integration and compactness of the auxiliary mechanism adopting the mounting bracket are improved, and the weight of the auxiliary mechanism is reduced.

In some examples, as illustrated by FIG. 1 and FIG. 2, the second mounting plate 120 includes at least one second mounting hole 122 configured to mount a motor or an oil pump. Therefore, the second mounting hole 122 on the second mounting plate 120 can also be used for mounting a motor or an oil pump.

In some examples, as illustrated by FIG. 1 and FIG. 2, the orthographic projection of one of the at least one second mounting hole 122 on the first mounting plate 110 is at least partially overlapped with one of the at least one first mounting hole 112. That is to say, one second mounting hole 122 is provided corresponding to one first mounting hole 112 on the first mounting plate 110. The first mounting hole 112 and the second mounting hole 122 corresponding to the first mounting hole 112 can constitute a mounting unit; one of the first mounting hole 112 and the second mounting hole 122 in the mounting unit can be used for mounting a motor and the other one of the first mounting hole 112 and the second mounting hole 122 in the mounting unit can be used for mounting an oil pump, and the motor and the oil pump can be coaxially connected so that the motor can drive the oil pump to work. Therefore, the mounting bracket can improve the coaxiality between the motor and the oil pump, thereby improving the mechanical efficiency of the oil pump, reducing noise and prolonging the service life of the product.

In some examples, as illustrated by FIG. 1 and FIG. 2, the first mounting plate 110 includes a plurality of first mounting holes 112, and the plurality of first mounting holes 112 are arranged around the first fixing hole 115. Therefore, the first mounting plate 110 can be used to mount a plurality of motors or oil pumps, so that an integration level can be further improved. In addition, because the plurality of first mounting holes 112 are arranged around the first fixing hole 115, the first fixing hole 115 and the tubular connection structure 140 have a better reinforcing effect on the mounting bracket.

In some examples, as illustrated by FIG. 1 and FIG. 2, the mounting bracket 100 further includes a first bracket 161 and a second bracket 162; the first bracket 161 is connected with the first mounting plate 110 and includes a first connection portion 1612; the second bracket 162 is connected with the second mounting plate 120 and includes a second connection portion 1622; the first connection portion 1612 and the second connection portion 1622 are oppositely arranged and spaced apart, and the first connection portion 1621 and the second connection portion 1622 are respectively configured to connect the motor and the oil pump. Therefore, the first connection portion 1621 and the second connection portion 1622 can additionally provide a mounting unit or a mounting location for mounting a motor and an oil pump which are correspondingly arranged. Therefore, the mounting bracket can further improve the integration level.

In some examples, as illustrated by FIG. 1 and FIG. 2, the distance between the first connection portion 1621 and the second connection portion 1622 is greater than the distance between the first mounting plate 110 and the second mounting plate 120. Therefore, the first connection portion 1621 and the second connection portion 1622 can be used to mount a larger motor and oil pump, or can be used to mount "one machine with two pumps". It should be noted that the above-mentioned "one machine with two pumps" refers to that one motor drives two oil pumps.

For example, as illustrated by FIG. 1 and FIG. 2, the second bracket 162 may further include a rotational speed measuring shield 1623, which is arranged at a side of the second connection portion 1622 away from the first connection portion 1621 and used for measuring the rotational speed.

Figure 3:
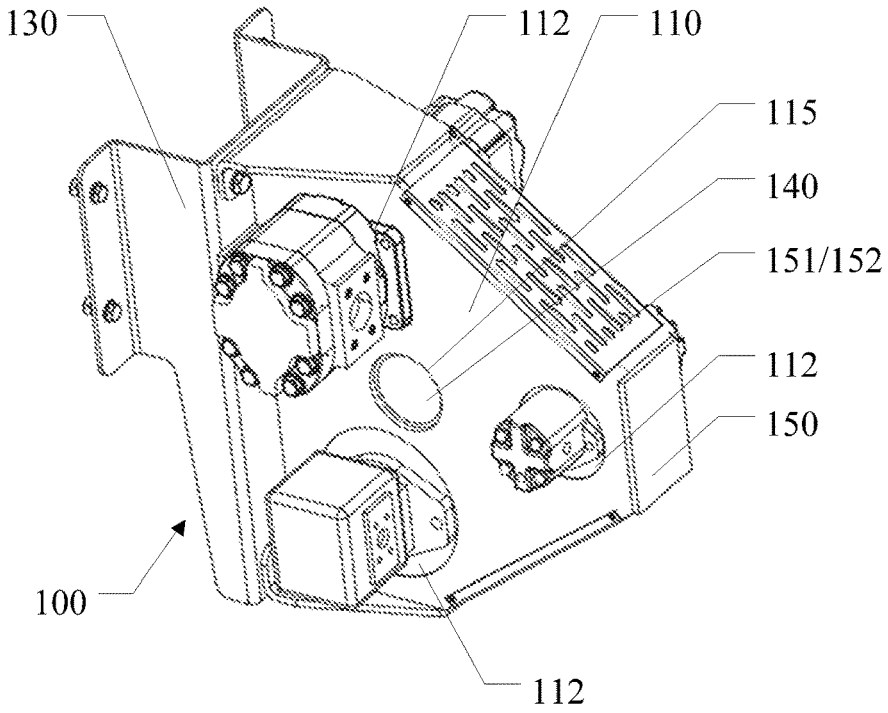
FIG. 3 is a structural schematic diagram of another mounting bracket provided by an embodiment of the disclosure.

FIG. 3 is a structural schematic diagram of another mounting bracket provided by an embodiment of the disclosure. As illustrated by FIG. 3, the first mounting plate 110 includes the plurality of first mounting holes 112, and the second mounting plate 120 also includes a plurality of second mounting holes 122, which are arranged around the second fixing hole 125. Therefore, the second mounting plate 120 can be used for mounting a plurality of motors or oil pumps, so that the integration level can be further improved. In addition, because a plurality of second mounting holes 122 are arranged around the second fixing hole 125, the second fixing hole 125 and the tubular connection structure 140 have a better reinforcing effect on the mounting bracket.

In some examples, as illustrated by FIG. 3, the plurality of first mounting holes 112 and the plurality of second mounting holes 122 are arranged in one-to-one correspondence; that is to say, the number of the first mounting holes 112 is the same as that of the second mounting holes 122, and one first mounting hole 112 corresponds to one second mounting hole 122. The first mounting hole 112 and second mounting hole 122 corresponding to the first mounting hole 112 can constitute a mounting unit; one of the first mounting hole 112 and the second mounting hole 122 in the mounting unit can be used for mounting a motor and the other can be used for mounting an oil pump, and the motor and the oil pump can be coaxially connected so that the motor can drive the oil pump to work. Therefore, the mounting bracket can improve the coaxiality between the motor and the oil pump while arranging multiple groups of motors and oil pumps on one mounting bracket, thereby improving the mechanical efficiency of the oil pump, reducing noise and prolonging the service life of products.

In some examples, as illustrated by FIG. 3, the first mounting plate 110 includes three first mounting holes 112, and the second mounting plate 120 includes three second mounting holes 122; the central connecting lines of the three first mounting holes 112 form a triangular; the central connecting lines of the three second mounting holes 122 form a triangular.

Figure 4A:
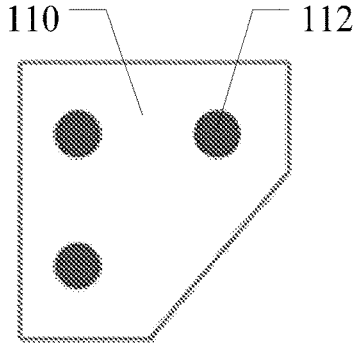
FIG. 4A is a planar structural schematic diagram of a first mounting plate provided by an embodiment of the disclosure.
Figure 4B:
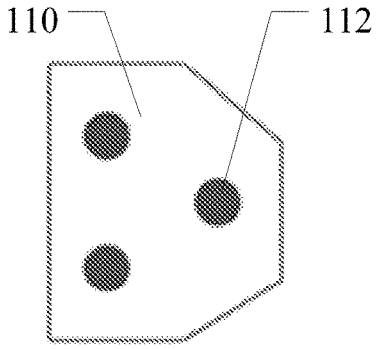
FIG. 4B is a planar structural schematic diagram of another first mounting plate provided by an embodiment of the disclosure.
Figure 4C:
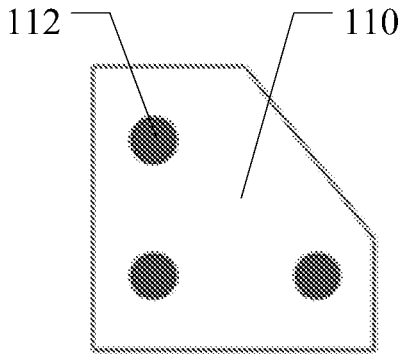
FIG. 4C is a planar structural schematic diagram of another first mounting plate provided by an embodiment of the disclosure.

FIG. 4A is a planar structural schematic diagram of a first mounting plate provided by an embodiment of the disclosure; FIG. 4B is a planar structural schematic diagram of another first mounting plate provided by an embodiment of the disclosure; FIG. 4C is a planar structural schematic diagram of another first mounting plate provided by an embodiment of the disclosure. As illustrated by FIGS. 4A-4C, the first mounting plate 110 includes three first mounting holes 112, and the central connecting lines of the three first mounting holes 112 form a triangular.

For example, as illustrated by FIGS. 4A-4C, the central connecting lines of the three first mounting holes 122 can form an acute triangle or a right triangle.

Figure 5:
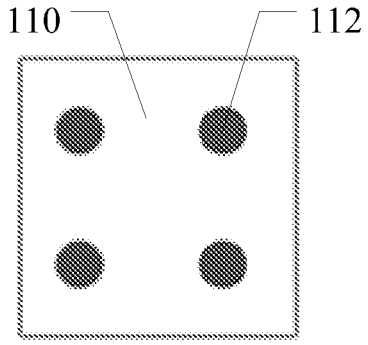
FIG. 5 is a planar structural schematic diagram of another first mounting plate provided by an embodiment of the present disclosure.

FIG. 5 is a planar structural schematic diagram of another first mounting plate provided by an embodiment of the disclosure. As illustrated by FIG. 5, the first mounting plate 110 includes four first mounting holes 112, and the central connecting lines of the four first mounting holes 112 form a rectangular.

Figure 6:
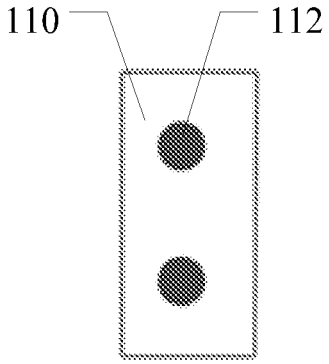
FIG. 6 is a planar structural schematic diagram of another first mounting plate provided by an embodiment of the present disclosure.

FIG. 6 is a planar structural schematic diagram of another first mounting plate provided by an embodiment of the disclosure. As illustrated by FIG. 6, the first mounting plate 110 includes two first mounting holes 112. Of course, the embodiment of the present disclosure does not specifically limit the number of the first mounting holes; the first mounting plate can also be provided with other numbers of first mounting holes.

Figure 7:
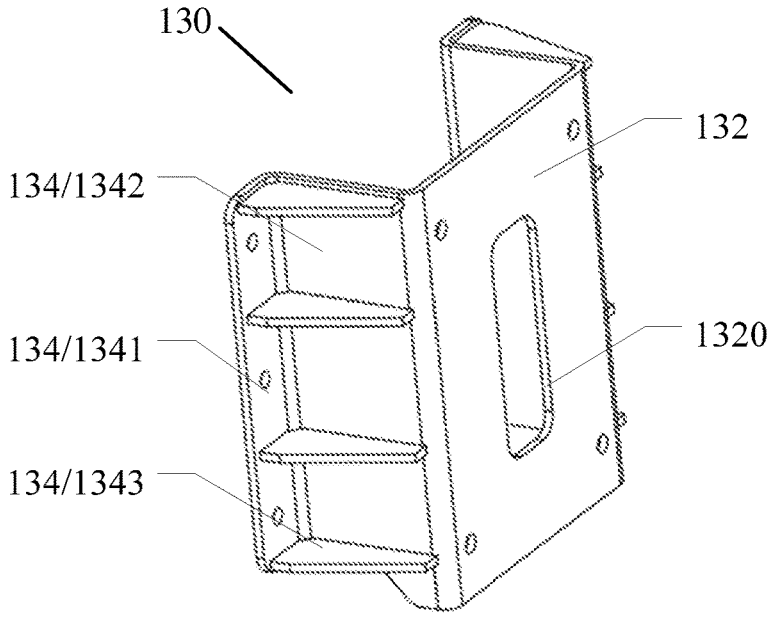
FIG. 7 is a structural schematic diagram of a mounting base in a mounting bracket provided by an embodiment of the disclosure.

FIG. 7 is a structural schematic diagram of a mounting base in a mounting bracket provided by an embodiment of the disclosure. As illustrated by FIG. 7, the mounting base 130 includes a mounting portion 132 and a fixing portion 134; one end of the fixing portion 134 is connected to the mounting portion 132, and another end of the fixing portion 134 is connected to an external device. For example, the external device can be a skid, semi-trailer or other vehicle-mounted device.

In some examples, as illustrated by FIG. 1 and FIG. 7, the mounting portion 132 includes a lightening hole 1320, one end of the first mounting plate 110 is fixed in a first region 1321 of the mounting portion 132, one end of the second mounting plate 120 is fixed in a second region 1322 of the mounting portion 132, and the first region 1321 and the second region 1322 are located on both sides of the lightening hole 1320. Therefore, the lightening hole 1320 can reduce the weight of the mounting base 130, and realize the lightweight design. In addition, the load on the mounting portion is evenly distributed, which can improve the stable support for the first mounting plate and the second mounting plate.

In some examples, as illustrated by FIG. 7, the fixing portion 134 includes a fixing plate 1341, a connecting plate 1342 and a rib plate 1343; one end of the connecting plate 1342 is connected with the fixing plate 1341, and another end of the connecting plate 1342 is connected with the mounting portion 132. The rib plate 1343 is located in an included angle between the fixing plate 1341 and the connecting plate 1342, and are respectively connected with the fixing plate 1341 and the connecting plate 1342, thereby improving the strength of the fixing portion 134. Therefore, the fixing portion 134 of the mounting base 130 can be better fixed with the external device.

For example, as illustrated by FIG. 7, the fixing plate 1341 may be provided with a plurality of bolt holes for setting bolts for fixing with the external device.

In some examples, as illustrated by FIG. 1 and FIG. 7, the mounting bracket 100 further includes an enclosing plate 150 located between the first mounting plate 110 and the second mounting plate 120 and connected to edges of the first mounting plate 110 and the second mounting plate 120. The enclosing plate 150 and the mounting base 130 enclose a space between the first mounting plate 110 and the second mounting plate 120, and the enclosing plate 150 includes a maintenance window 151 and an observation window 152. Therefore, upon the first mounting hole and the second mounting hole being respectively mounted with the motor and the oil pump, the space enclosed by the enclosing plate, the mounting base, the first mounting plate and the second mounting plate can protect the connection between the motor and the oil pump. In this case, the maintenance window and observation window can be used to observe and maintain the motor and oil pump.

Figure 8:
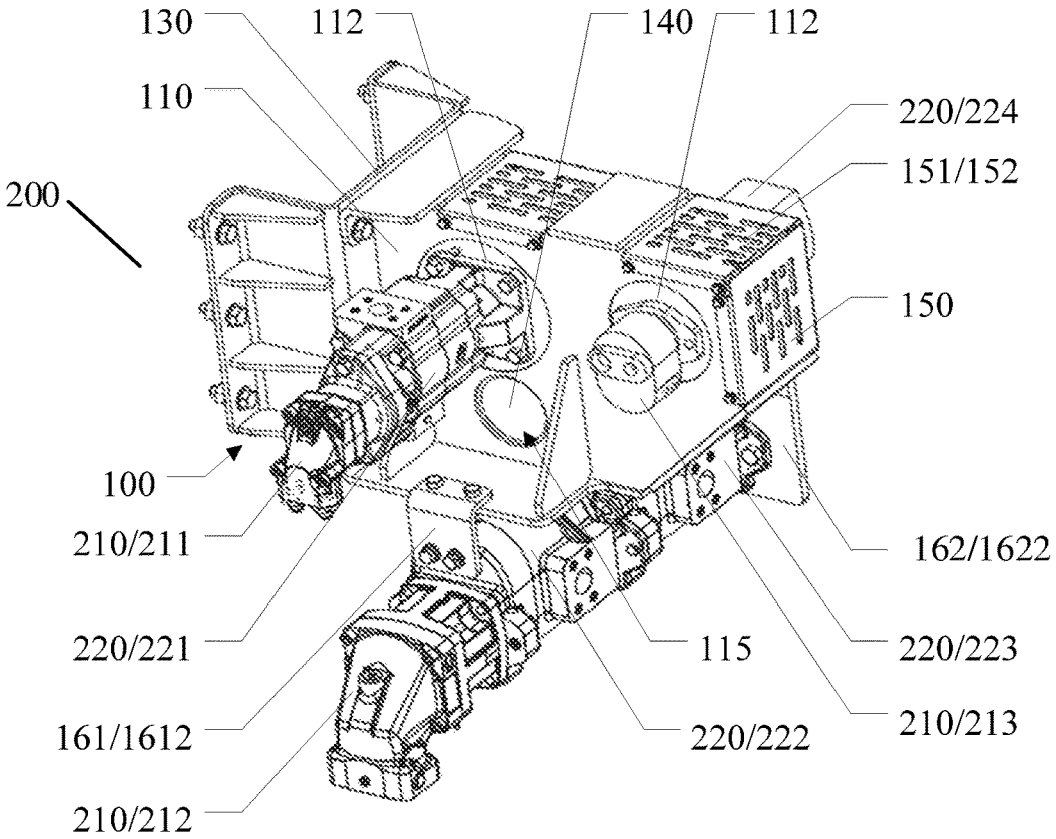
FIG. 8 is a structural schematic diagram of a first side of an auxiliary mechanism provided by an embodiment of the disclosure.
Figure 9:
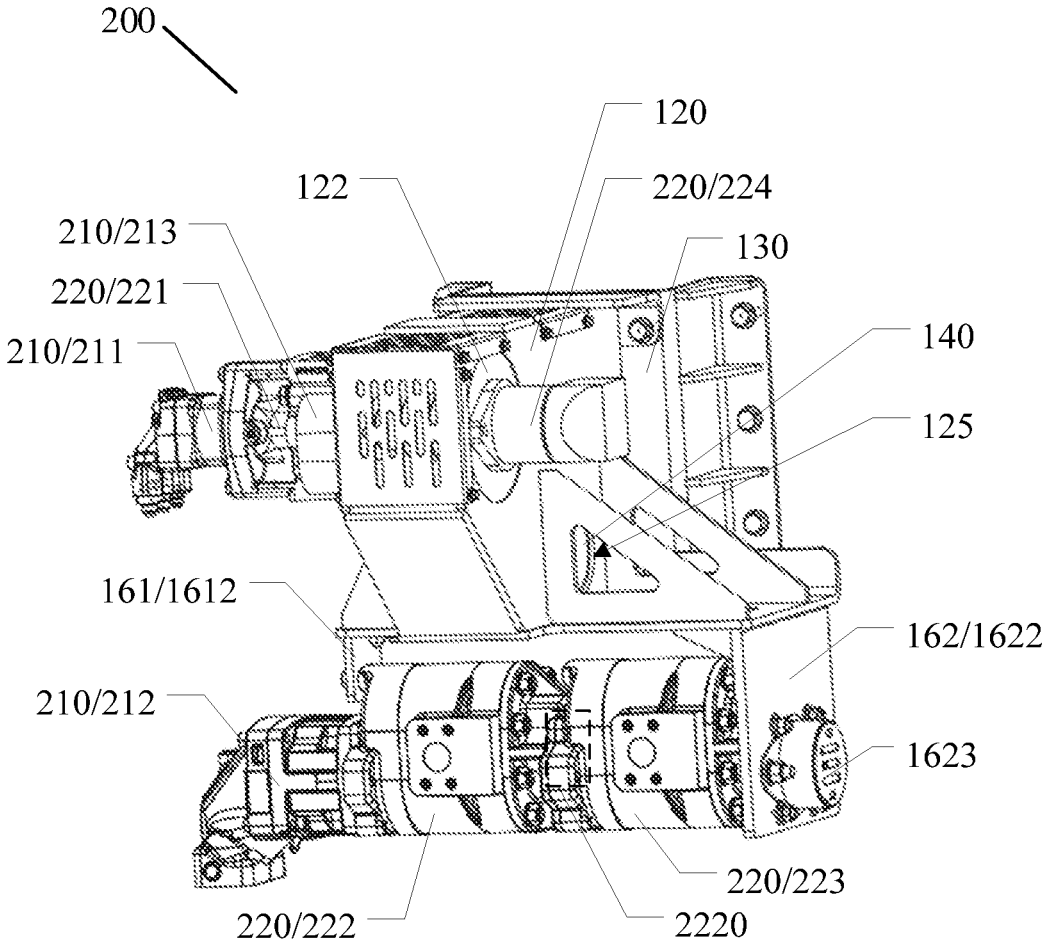
FIG. 9 is a structural schematic diagram of a second side of an auxiliary mechanism provided by an embodiment of the disclosure.

At least one embodiment of that present disclosure also provides an auxiliary mechanism. FIG. 8 is a structural schematic diagram of a first side of an auxiliary mechanism provided by an embodiment of the disclosure; FIG. 9 is a structural schematic diagram of a second side of an auxiliary mechanism provided by an embodiment of the disclosure. As illustrated by FIG. 8, an auxiliary mechanism 200 includes the mounting bracket 100 provided in the above embodiments, at least one motor 210 and at least one oil pump 220; the first mounting hole 112 of the mounting bracket 100 is mounted with one motor 210 or one oil pump 220. It should be noted that the auxiliary structure illustrated in FIG. 8 and FIG. 9 adopts the mounting bracket illustrated in FIG. 1 and FIG. 2. However, the embodiment of the present disclosure includes but is not limited thereto, and the auxiliary mechanism can also adopt the mounting bracket provided by other examples.

In the auxiliary mechanism provided by the embodiment of the disclosure, because the mounting bracket can be lightweight designed on the premise of high stability, the integration and the compactness of the auxiliary mechanism using the mounting bracket are also improved, and the weight of the auxiliary mechanism is reduced.

In some examples, as illustrated by FIG. 8 and FIG. 9, the at least one motor 210 includes a first motor 211, and the at least one oil pump 220 includes a first oil pump 221. The first oil pump 221 is mounted on the first mounting hole 112. The first motor 211 is connected to an end of the first oil pump 221 away from the first mounting plate 110 and is configured to directly drive the first oil pump 221. Therefore, the first motor and the first oil pump are directly connected without coupling, so that the coaxiality between the first motor and the first oil pump can be improved, thereby improving the mechanical efficiency, reducing noise and prolonging the service life. It should be noted that the motor and oil pump in the auxiliary mechanism provided by the embodiment of this disclosure can also be connected in other ways, such as coupling.

In some examples, as illustrated by FIG. 8 and FIG. 9, the mounting bracket 100 further includes a first bracket 161 and a second bracket 162; the first bracket 161 is connected with the first mounting plate 110 and includes a first connection portion 1612; the second bracket 162 is connected with the second mounting plate 120 and includes a second connection portion 1622; the first connection portion 1612 and the second connection portion 1622 are oppositely arranged and spaced apart, and the first connection portion 1621 and the second connection portion 1622 are respectively configured to connect a motor and an oil pump. Therefore, the first connection portion 1621 and the second connection portion 1622 can additionally provide a mounting unit or a mounting location for mounting a motor and an oil pump which are correspondingly arranged. Therefore, the mounting bracket can further improve the integration level.

In some examples, as illustrated by FIG. 8 and FIG. 9, the at least one motor 210 includes a second motor 212, and the at least one oil pump 220 includes a second oil pump 222 and a third oil pump 223. One end of the second oil pump 222 is connected with the first connection portion 1612, and one end of the third oil pump 223 is connected with the second connection portion 1622, and the second motor 212 is connected with the end of the second oil pump 222 connected with the first connection portion 1612, and the second motor 212 is configured to directly drive the second oil pump 222, which includes a power output shaft 2220, and the power output shaft 2220 of the second oil pump 222 is connected with one end of the third oil pump 223 away from the second connection portion 1622, and the power output shaft 2220 is configured to directly drive the third oil pump 223. Therefore, the auxiliary mechanism adopts the connection mode of "one machine with two pumps", thus improving the performance and reducing the weight.

In some examples, as illustrated by FIG. 8 and FIG. 9, the at least one motor 210 includes a third motor 213 and the at least one oil pump 220 includes a fourth oil pump 224; the third motor 213 is mounted on the first mounting hole 112, and the fourth oil pump 224 is mounted on the second mounting hole 122 corresponding to the first mounting hole 112. The third motor 213 and the fourth oil pump 224 are connected at an interval position between the first mounting plate 110 and the second mounting plate 120, and the connection can be directly or by a coupling. Therefore, the auxiliary mechanism adopts various ways of combining and mounting motors and oil pumps.

In some examples, the type of the at least one motor includes at least one of a hydraulic motor and an electric motor. Of course, the embodiments of the present disclosure include but are not limited thereto, and other types of motors can be used as motors to provide mechanical power for the oil pump.

In some examples, the type of the at least one oil pump includes at least one of a lubricating oil pump and a fuel oil pump. Therefore, upon the at least one oil pump of the auxiliary mechanism including a plurality of lubricating oil pumps, the auxiliary mechanism can simultaneously lubricate a plurality of devices, thereby improving the integration level; upon the at least one oil pump of the auxiliary mechanism including a lubricating oil pump and a fuel oil pump at the same case, the auxiliary mechanism can simultaneously lubricate the device and provide fuel for the prime mover, thereby further improving the integration level.

The following points required to be explained:

(1) The accompanying drawings involve only the structure(s) in connection with the embodiment(s) of the present disclosure, and other structure(s) can be referred to common design(s).

(2) In case of no conflict, the embodiments of the present disclosure and the features in the embodiments can be combined with each other to obtain new embodiments.

What have been described above are only specific implementations of the present disclosure, the protection scope of the present disclosure is not limited thereto, and easily conceivable changes or substitutions should be covered within the protection scope of the present disclosure. Therefore, the protection scope of the present disclosure should be based on the protection scope of the claims.

What is claimed is:

1. An auxiliary mechanism comprising a mounting bracket, the mounting bracket comprising:

a mounting base;

a first mounting plate fixed on the mounting base; and a second mounting plate fixed on the mounting base and arranged opposite to and spaced apart from the first mounting plate, wherein the first mounting plate comprises at least one first mounting hole and a first fixing hole, the second mounting plate comprises a second fixing hole, and the first mounting hole is configured to mount a motor or an oil pump, the mounting bracket further comprises a tubular connection structure between the first mounting plate and the second mounting plate, one end of the tubular connection structure is connected with an edge of the first fixing hole, and another end of the tubular connection structure is connected with an edge of the second fixing hole.

2. The auxiliary mechanism according to claim 1, wherein the second mounting plate comprises at least one second mounting hole configured to mount the motor or the oil pump.

3. The auxiliary mechanism according to claim 2, wherein an orthographic projection of one of the at least one second mounting hole on the first mounting plate at least partially overlap with one of the at least one first mounting hole.

4. The auxiliary mechanism according to claim 1, wherein the first mounting plate comprises a plurality of first mounting holes, and the plurality of first mounting holes are arranged around the first fixing hole.

5. The auxiliary mechanism according to claim 4, wherein a number of the plurality of first mounting holes can be any one of 2, 3 and 4.

6. The auxiliary mechanism according to claim 1, wherein the mounting base comprises:

a mounting portion; and a fixing portion, one end of the fixing portion being connected with the mounting portion, and another end of the fixing portion being configured to be connected with an external device, wherein the mounting portion comprises a lightening hole, one end of the first mounting plate is fixed in a first region of the mounting portion, one end of the second mounting plate is fixed in a second region of the mounting portion, and the first region and the second region are located at both sides of the lightening hole.

7. The auxiliary mechanism according to claim 6, wherein the fixing portion comprises:

a fixing plate;

a connecting plate, one end of the connecting plate being connected with the fixing plate and another end of the connecting plate being connected with the mounting portion; and a rib plate located in an included angle between the fixing plate and the connecting plate and connected with the fixing plate and the connecting plate.

8. The auxiliary mechanism according to claim 6, further comprising:

an enclosing plate located between the first mounting plate and the second mounting plate and connected with edges of the first mounting plate and the second mounting plate, wherein the enclosing plate and the mounting base are configured to enclose a space between the first mounting plate and the second mounting plate, and the enclosing plate comprises at least one of a maintenance window and an observation window.

9. The auxiliary mechanism according to claim 1, further comprising:

a first bracket connected with the first mounting plate and comprising a first connection portion; and a second bracket connected with the second mounting plate and comprising a second connection portion, wherein the first connection portion and the second connection portion are oppositely arranged and spaced apart, and the first connection portion and the second connection portion are respectively configured to connect with one and the other of the motor and the oil pump, respectively.

10. The auxiliary mechanism according to claim 9, wherein a distance between the first connection portion and the second connection portion is greater than a distance between the first mounting plate and the second mounting plate.

11. The auxiliary mechanism of claim 1, further comprising:

the motor; or the oil pump, wherein the motor or the oil pump is mounted at the first mounting hole.

12. The auxiliary mechanism according to claim 11, wherein the oil pump is mounted in the first mounting hole, and the motor is connected with an end of the oil pump away from the first mounting plate and is configured to directly drive the oil pump.

13. The auxiliary mechanism according to claim 12, wherein:

the mounting bracket further comprises a first bracket connected with the first mounting plate and comprising a first connection portion, and a second bracket connected with the second mounting plate and comprising a second connection portion;

the first connection portion and the second connection portion are oppositely arranged and spaced apart;

the auxiliary mechanism further comprises a second motor, a second oil pump, and a third oil pump, one end of the second oil pump is connected with the first connection portion, and one end of the third oil pump is connected with the second connection portion;

the second motor is connected to the end of the second oil pump and configured to directly drive the second oil pump; and the second oil pump comprises a power output shaft, and the power output shaft of the second oil pump is connected with one end of the third oil pump away from the second connection portion and configured to directly drive the third oil pump.

14. The auxiliary mechanism according to claim 11, wherein a type of the motor comprises one of a hydraulic type or an electric type.

15. The auxiliary mechanism according to claim 11, wherein a type of the oil pump comprises one of a lubricating oil pump type or a fuel oil pump type.

16. A method comprising providing a mounting bracket, the mounting bracket comprising:

a mounting base;

a first mounting plate fixed on the mounting base; and a second mounting plate fixed on the mounting base and arranged opposite to and spaced apart from the first mounting plate, wherein the first mounting plate comprises at least one first mounting hole and a first fixing hole, the second mounting plate comprises a second fixing hole, and the first mounting hole is configured to mount a motor or an oil pump, the mounting bracket further comprises a tubular connection structure between the first mounting plate and the second mounting plate, one end of the tubular connection structure is connected with an edge of the first fixing hole, and another end of the tubular connection structure is connected with an edge of the second fixing hole.

* * * * *